US006056247A

United States Patent [19]

Hoglund

[11] Patent Number: 6,056,247

[45] Date of Patent: May 2, 2000

[54] WRIST SUPPORT

[75] Inventor: Per Hoglund, Eskilstuna, Sweden

[73] Assignee: Volvo Wheel Loaders AB, Eskilstuna, Sweden

[21] Appl. No.: 09/172,083

[22] Filed: Oct. 14, 1998

[30] Foreign Application Priority Data

Oct. 14, 1997 [SE] Sweden ..... 9703742

[51] Int. Cl.[7] ..... B43L 15/00

[52] U.S. Cl. ..... 248/118.1; 248/118.5

[58] Field of Search ..... 248/118, 118.1, 248/118.3, 118.5, 918, 291, 281.11, 281.1; 297/411.35, 397; 400/715

[56] References Cited

U.S. PATENT DOCUMENTS

| | | | |
|---|---|---|---|
| 1,308,355 | 7/1919 | Hollins | 248/118.1 |
| 1,628,030 | 5/1927 | Catlett | 248/118 X |
| 4,971,393 | 11/1990 | Maisenhalder | 297/397 |
| 4,996,977 | 3/1991 | Tiedeken | 248/118 X |
| 5,050,826 | 9/1991 | Johnson | 248/118.3 |
| 5,108,057 | 4/1992 | Dandy, III et al. | 248/118 |
| 5,183,230 | 2/1993 | Walker et al. | 248/118 |
| 5,386,956 | 2/1995 | Hatcher | 248/118 |
| 5,467,950 | 11/1995 | Dumitru . | |
| 5,478,034 | 12/1995 | Cunningham et al. . | |

*Primary Examiner*—Ramon O. Ramirez
*Assistant Examiner*—Tan Le
*Attorney, Agent, or Firm*—Young & Thompson

[57] ABSTRACT

Supporting device (12) for the wrist during manipulation of a joystick control (10), comprising at least one elongated roller body (14) rotatably mounted in a holder (16) which is designed to be mounted in a mounting (18) adjacent to and behind the joystick (20) with its rotational axis oriented essentially horizontally and essentially perpendicular to the forward and backward direction of movement of the joystick (20).

6 Claims, 3 Drawing Sheets

WRIST SUPPORT

BACKGROUND OF THE INVENTION

The present invention relates to a device for supporting the wrist when operating a joystick in a work vehicle, such as a loader or excavator.

DESCRIPTION OF THE RELATED ART

A one-stick control is used in a number of types of construction machines to control various operating functions of the machine. The joystick is subjected to relatively extensive movement, especially forward and backward movement which, when a stationary, non-moving wrist support is used, causes significant wrist bending and risk of occupational injury. If the operator chooses to push his forearm along his support instead of bending the wrist, there will be friction against the support so that the operator will tend to lift his arm with accompanying risk for shoulder problems.

Arm supports have also been developed which cover the entire forearm and can slide back and forth on underlying rails. Since the operator's seat can normally perform vertical spring movements, such supports are not suitable for fixed mounting together with the joystick in the operator cab. A support far back on the forearm can, in this context, also transmit undesirable vibrations up to the shoulder.

U.S. Pat. No. 5,478,034 describes a wrist support in the form of a roller body supporting the wrist for reciprocal movement when working at a keyboard. The arm support according to the present invention is, however, intended to solve a different problem which is specific to operating joysticks in work vehicles, where the person sitting in the operator seat can be subjected to relatively large movements vertically during the movements of the vehicle and its implement, thus subjecting the operator's arm to pivot movements in the vertical plane. The wrist support according to the invention, in addition to being a roller support for forward and backward movements when manipulating a joystick is also a hinge support for vertical movements such as a seesaw or a two-arm lever with a horizontal fulcrum. This is clearly not the case in the known roller support for keyboards.

SUMMARY OF THE INVENTION

One purpose of the present invention is to substantially eliminate the disadvantages of the previously known arm and wrist supports of the type in question and to suggest a simple support arrangement which permits a compliant support for the wrist during operation of a joystick control.

For this purpose, the device according to the invention is characterized in that it comprises at least one elongated roller body rotatably mounted in a holder, said holder being designed to be mounted in a mounting in such a manner that the roller body is held placed in the immediate vicinity of and behind the joystick, with its rotational axis oriented essentially horizontally and essentially perpendicular to the forward and backward direction of movement of the joystick.

Even though a single roller body can provide adequate wrist support, a preferred embodiment has two parallel adjacent roller bodies which provide improved support in the form of better distribution of the supporting forces against the wrist.

The roller bodies have an outer layer of soft cellular plastic material, for example.

Furthermore, the roller bodies can be either supported at both ends or only at one end in the holder, which in turn can be adjustable to desired directions in its mounting.

Additional features of the device according to the invention are disclosed in the attached dependent claims.

BRIEF DESCRIPTION OF THE DRAWINGS

The invention will be described in more detail below with reference to the accompanying drawings, of which.

DESCRIPTION OF THE PREFERRED EMBODIMENTS

Figure 1:
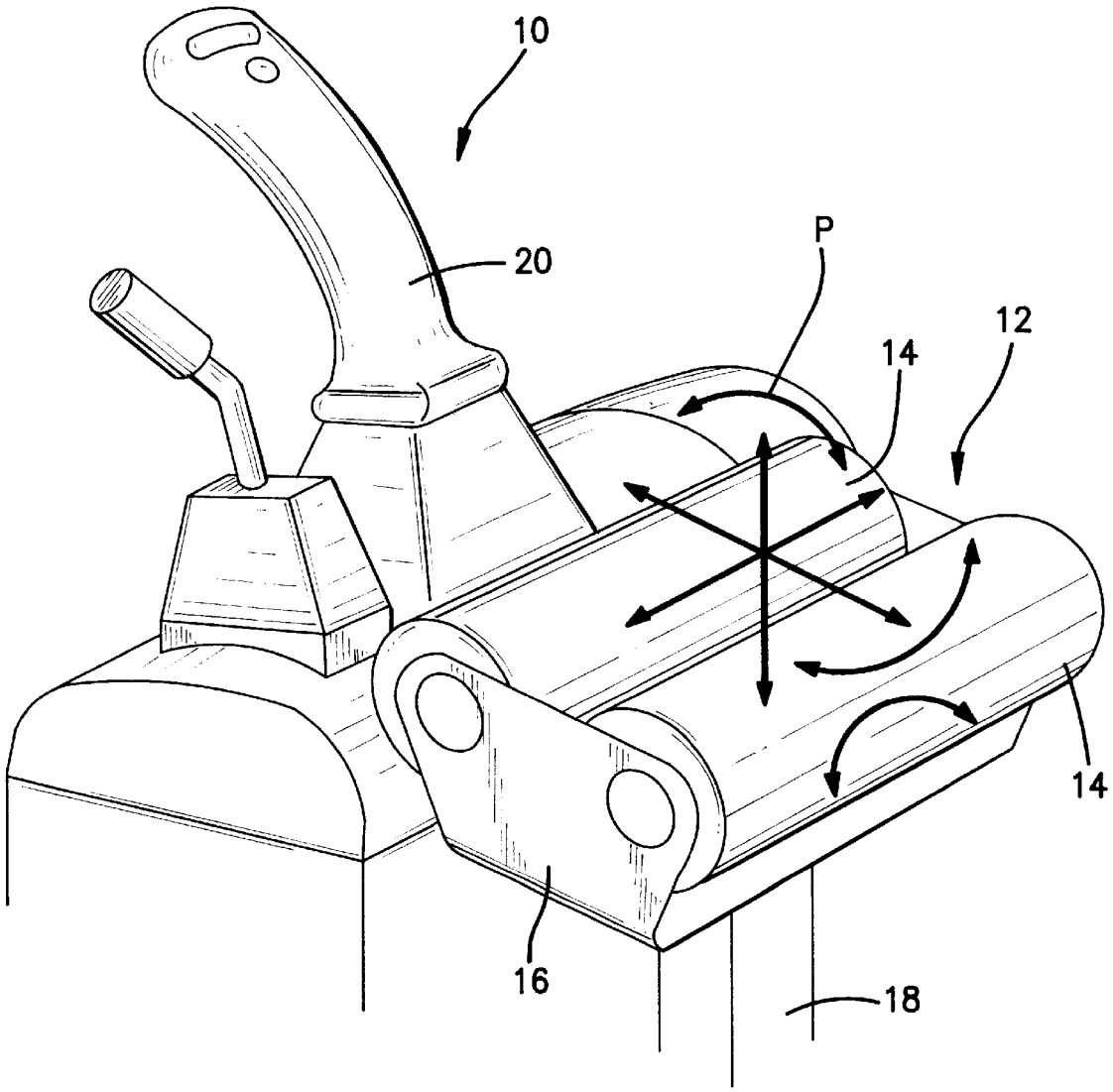
FIG. 1 is a schematic perspective view of a first embodiment of a supporting device according to the invention mounted immediately behind a joystick control.

In FIG. 1, the numeral 10 generally designates a joystick control of an excavator machine, for example, and an associated wrist support 12 according to the invention.

The wrist support 12 in FIG. 1 comprises two parallel adjacent elongated roller bodies 14, which are rotatably mounted in an essentially U-shaped holder 16. The holder 16 is adjustably mounted in a mounting 18 in such a manner (not shown in more detail here) that the roller bodies 14 can be adjusted in the directions indicated by the arrows, in a position immediately behind the joystick 20. The rotational axes of the rollers 14 lie essentially horizontal and are essentially perpendicular to the forward and backward directions of movement of the joystick 20. In the embodiment according to FIG. 1, the roller bodies 14 are journalled at both ends in the holder 16. The roller holder 16 can be limitedly flexibly movable in the direction of the arrow P in FIG. 1, i.e. about an axis parallel to and located under the axes of the roller bodies 14, to permit the roller bodies 14 to follow the wrist and thus provide evenly distributed contact with the wrist when the joystick is moved forwards and backwards. The two roller bodies can be pivoted together about this axis as the operator and his arm move vertically, either with the roller holder freely movably mounted or spring-biased to an end or neutral position.

Figure 2:
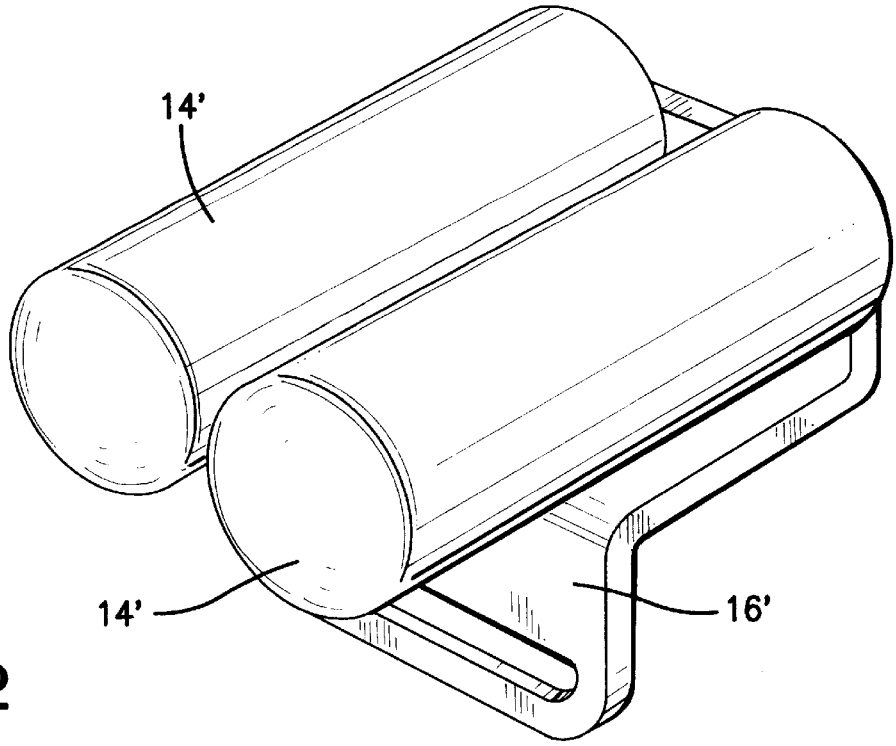
FIG. 2 shows another embodiment of a supporting device according to the invention with a cantilevered bearing of the supporting rollers.
Figure 3:
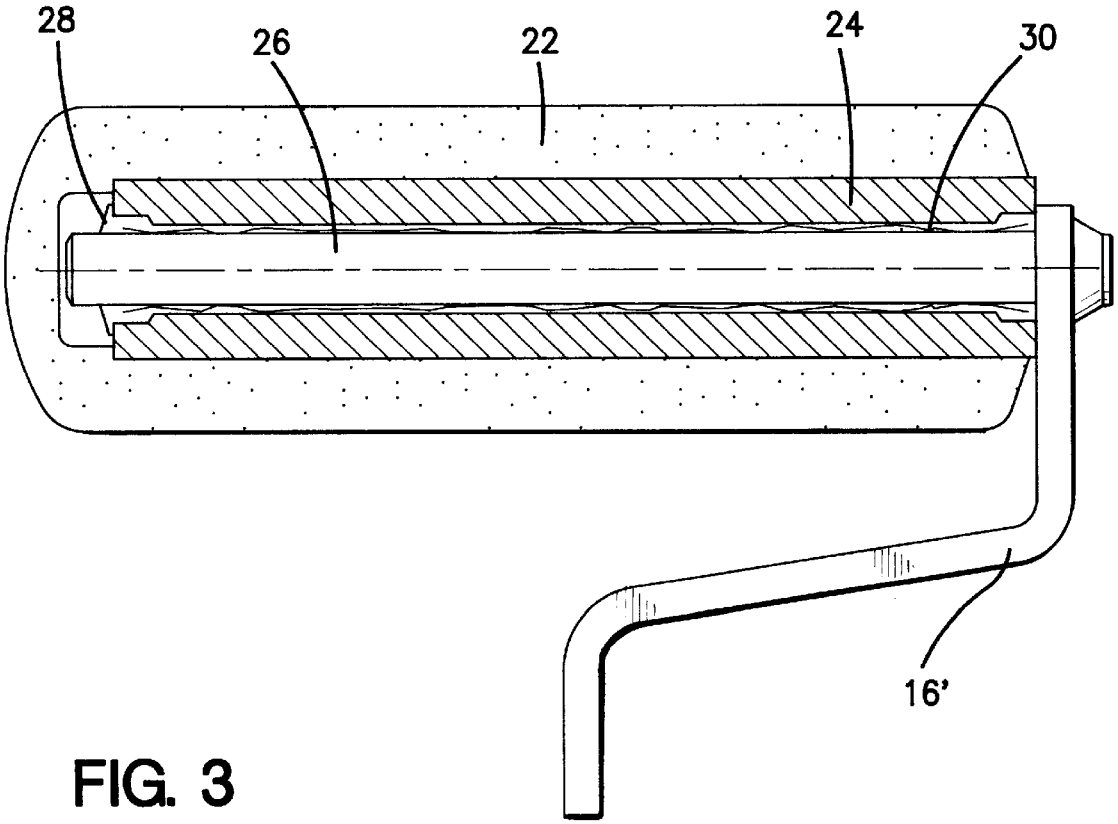
FIG. 3 shows a cross section through a supporting roller in FIG. 2.

In the embodiment according to FIGS. 2 and 3, the two roller bodies 14' are mounted cantilevered in a rigid, double-angled roller holder 16 of steel, for example, which provides a somewhat more open and space-saving device. The roller bodies 14'—as do the roller bodies 14 in FIG. 1—comprise an outer soft layer 22 of cellular plastic material, for example, on top of a more rigid, tubular core 24 of polypropylene, for example. The core 24 is slipped onto its respective bearing pin 26, which is anchored in the holder 16" and fixed by means of a lock-washer 28. In order to prevent noise due to vibrations in the vehicle, a "sock" 30 can be placed between the bearing pin 26 and the core 24.

Figure 4:
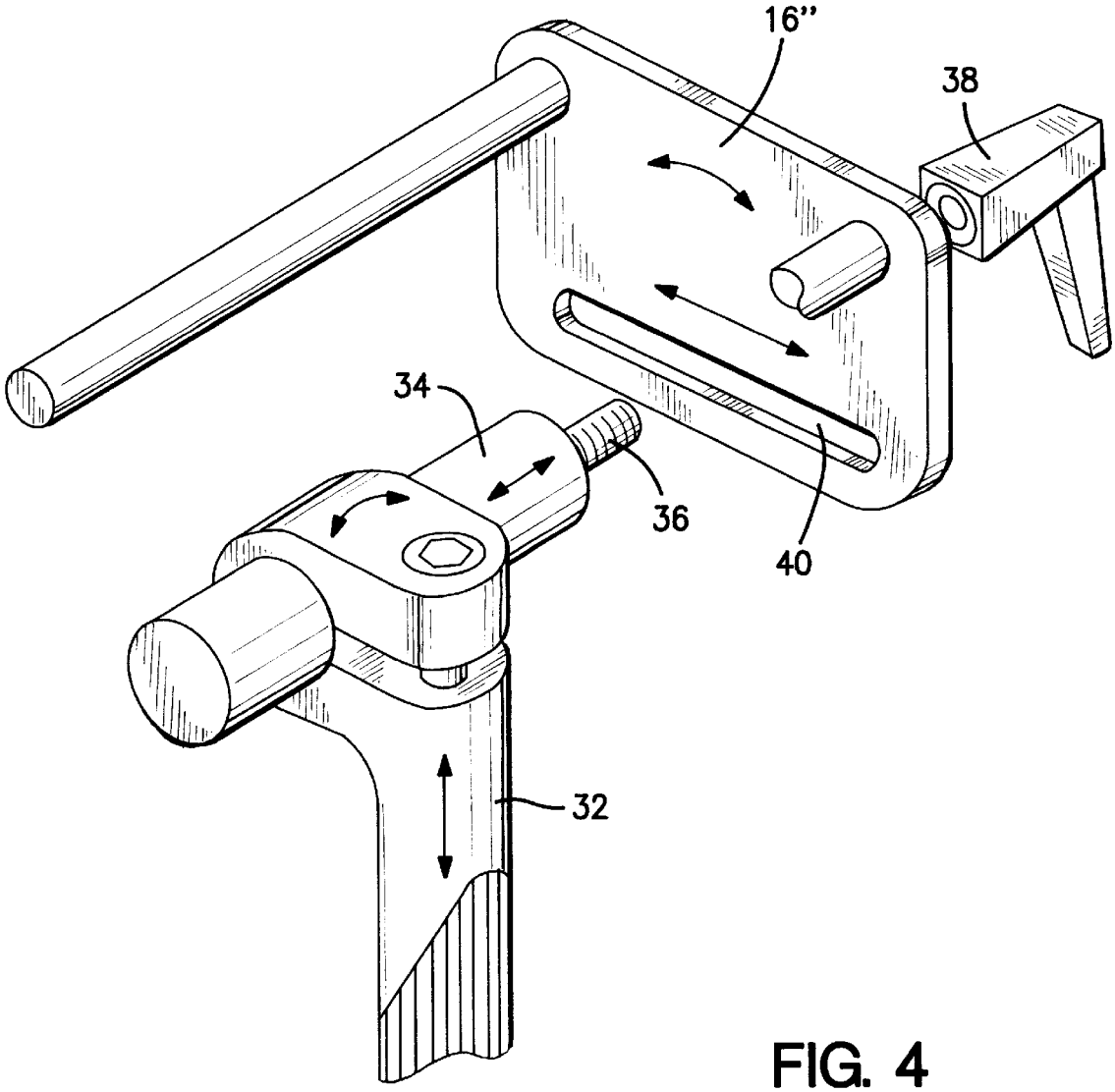
FIG. 4 shows schematically a proposed universal adjustment of the roller holder in a mounting.

FIG. 4 shows an example of a universal mounting of a roller holder 16" to provide adjustability of the rollers in desired directions, in accordance with the arrows. The mounting comprises a vertically adjusted and rotatable post 32, which supports a horizontally adjustable shaft 34 with a fixing screw 36, which can be locked by means of a nut 38 in a slot 40 in the holder 16". Many other mountings are conceivable to achieve the desired adjustment of the wrist support according to the invention adjacent the joystick 10.

Within the scope of the invention, it is also conceivable to allow an endless belt (not shown) to run around the roller bodies 14,14', to prevent foreign objects from jamming between them. It is also possible to use more than two roller bodies.

What is claimed is:

1. Device for supporting the wrist when manipulating a joystick control in a work vehicle, said device comprising at least two elongated adjacent roller bodies rotatably mounted in a holder about separate horizontal axes in a parallel side-by-side relationship, said holder being pivotally adjustably mounted in a mounting about an axis which is parallel to and located beneath the rotational axes of the roller bodies.

2. Device according to claim 1, wherein each roller body comprises an outer, relatively soft layer of material.

3. Device according to claim 2, wherein each roller body comprises an inner, tubular core of a relatively hard material.

4. Device according to claim 1, wherein each roller body is mounted on a bearing pin fixed in the holder.

5. Device according to claim 1, wherein each roller body is mounted cantilevered in the holder.

6. Device according to claim 1, wherein the roller holder is linearly adjustably mounted in its mounting in along a line towards and away from the joystick control.

* * * * *